US006174217B1

(12) United States Patent
Judson

(10) Patent No.: US 6,174,217 B1
(45) Date of Patent: Jan. 16, 2001

(54) UNDERGARMENTS WITH MULTIPLE INSERTS

(76) Inventor: Michelle L. Judson, 3112 SE. 56th Ave., Portland, OR (US) 97206

( * ) Notice: Under 35 U.S.C. 154(b), the term of this patent shall be extended for 0 days.

(21) Appl. No.: 09/505,205

(22) Filed: Feb. 16, 2000

(51) Int. Cl.[7] ..... A41C 3/00; A41B 9/04

(52) U.S. Cl. ..... 450/1; 450/30; 450/7; 2/67; 2/406

(58) Field of Search ..... 450/1, 7–10, 17, 450/19, 30, 36, 89, 92, 95, 98, 99, 108, 149–151, 156; 40/586; 2/67, 69, 227, 238, 228, 400–408, 105, 106, 80

(56) References Cited

U.S. PATENT DOCUMENTS

| | | | | |
|---|---|---|---|---|
| 2,698,940 | * | 1/1955 | Dombek | 450/1 |
| 2,880,731 | * | 4/1959 | Kendall | 2/105 |
| 3,630,208 | | 12/1971 | Werth . | |
| 4,185,332 | | 1/1980 | Jahnig . | |
| 4,222,388 | | 9/1980 | Brown . | |
| 4,607,640 | | 8/1986 | McCusker . | |
| 5,098,330 | | 3/1992 | Greenberg . | |
| 5,334,082 | | 8/1994 | Barker . | |
| 5,496,205 | | 3/1996 | Lee . | |
| 5,868,601 | | 2/1999 | Kelemencky . | |

* cited by examiner

*Primary Examiner*—Gloria M. Hale
(74) *Attorney, Agent, or Firm*—Ingrid McTaggart

(57) ABSTRACT

An undergarment comprises a skin-contacting panel and an outer sheer panel which define a pocket therebetween. The pocket is adapted for interchangeably receiving an insert wherein the insert can be seen through the sheer panel. Inserts are provided in a variety of colors, appearances, or scents for placement into the undergarments to change the decorative scheme of the undergarment. Attachments may also be provided that comprise button covers or bows which are attached to the undergarments, wherein the attachments preferably match the color of a particular insert.

23 Claims, 5 Drawing Sheets

UNDERGARMENTS WITH MULTIPLE INSERTS

TECHNICAL FIELD

The present invention relates to undergarments, and more particularly, to undergarments having multiple interchangeable inserts that change the appearance or the scent of the undergarments.

BACKGROUND OF THE INVENTION

Undergarments, such as brassieres, panties, nightgowns and lingerie, have evolved into high priced fashion items. Brassieres may cost as much as sixty dollars, panties may cost as much as thirty-five dollars, and lingerie may cost as much as one hundred dollars for a particularly fancy garment. An individual desiring to have undergarment items or sets of items in a variety of colors may spend several hundred dollars on their undergarment wardrobe. These high prices typically limit the number of garments that are purchased.

Undergarments are often sold in matching color sets so that the purchaser may coordinate his or her undergarment pieces with one another or with the particular outerwear being worn. For example, a peach colored brassiere and pair of panties may be worn with a peach colored sundress, or a pink nightgown may be worn with a matching pair of pink house slippers. Undergarments of differing colors may also be desired merely for the purpose of variety. However, as stated above, the high prices of these items typically limit the number of different colored undergarments that are purchased.

Persons wearing fancy undergarments often times desire to wear perfume or other pleasant scents that coordinate with the color of the undergarments. However, many individuals are allergic to or have skin reactions to perfume or scented oils placed directly on their skin. Individuals may also desire to have several different scents available for use.

Accordingly, there is a need for undergarments sold in a variety of colors and/or decorative styles which allow a purchaser to coordinate outfits and add variety to their wardrobe without spending large sums of money. Moreover, there is a need to provide undergarments having a variety of pleasant scents and which do not irritate the skin of the person wearing the undergarments.

SUMMARY OF THE INVENTION

Accordingly, an object of the present invention is to provide undergarments with multiple inserts that facilitate color coordination of the undergarments with each other and with a variety of different colored outerwear.

Another object of the present invention is to provide undergarments with multiple inserts or attachments that facilitate changing the appearance or style of the undergarments by changing the inserts or attachments.

Still a further object of the present invention is to provide undergarments with multiple inserts that facilitate variety in a wardrobe without being cost prohibitive.

Yet another object of the present invention is to provide undergarments with multiple inserts that facilitate a variety of scents in a wardrobe without requiring a person to apply perfumes or oils directly to their skin.

Accordingly, the present invention comprises undergarments with multiple inserts wherein the inserts are provided in a variety of colors or scents for placement into the undergarments. In one embodiment the inserts may be pink in color and have the scent of baby powder. In another embodiment the inserts may be green in color and have the scent of a well-known perfume. Attachments may also be provided that comprise button covers or bows which are attached to the undergarments, wherein the attachments preferably match the color of a particular insert. Accordingly, an individual on a limited budget may create a personal undergarment wardrobe having multiple styles, colors and scents with the use of only one or more pairs of undergarments and multiple colored or scented inserts and attachments.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
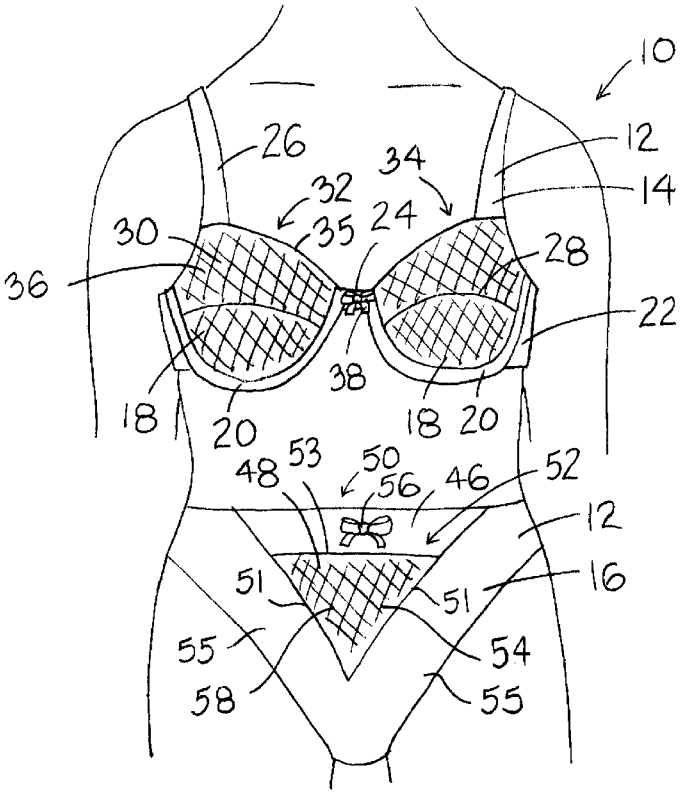
FIG. 1 is a front environmental view of a brassiere and pair of panties of the present invention worn by an individual.

Referring to FIG. 1, which is a front environmental view of a brassiere and pair of panties of the present invention worn by an individual, an individual 10 is shown wearing undergarments 12. The term "undergarments" refers to brassieres, panties, boxers, girdles, nylons, lingerie, teddies, chemises, nightgowns, bloomers, boustiers, slips, petticoats, bikinis, other types of swimsuits, and the like. In the figure shown, undergarments 12 include a brassiere 14 and a pair of panties 16. Brassier 14 includes two breast cups 18 supported by underwires 20, a backstrap 22, a central front connection region 24, shoulder straps 26 and a back hook region (not shown), as known in the art. In the strapless version of brassiere 14, shoulder straps 26 are eliminated and backstrap 22 may be reinforced. Cups 18 typically include a central seam 28 extending across the breast cup wherein the seam gives a rounded shape to the breast cup.

Breast cups 18 each comprise a cup shaped region which is manufactured in a variety of sizes for a variety of different bust sizes. The cups each include an outer sheer panel 30 and an inner, breast-contacting panel 32, which define a pocket 34 therebetween. Sheer panel 30 and breast-contacting panel 32 typically are sewn together along underwires 20 so that pocket 34 is accessed along a top region 35 of the breast cups. However, access to the pocket may be made in any region such as in a lower region or in a side region of the breast cups. Sheer panel 30 is designated in the figure with cross-hatching to indicate the sheer portion of the panel. An insert 36 may be placed within pocket 34 as will be described below. Sheer panel 30 may be manufactured of a very thin, transparent material such as tricot, netting, tulle, chiffon, organza or scrim. Sheer panel 30 may also be manufactured of a material having opaque regions and transparent or open regions, such as lace, burn-out or cut-work material, so that only portions of the panel are transparent. For purposes of this disclosure, the sheer panel will be described as "transparent" which can mean a sheer material or a material having cut-out regions. The panel may be manufactured of polyester, cotton, or any other suitable material. Due to the sheer properties of sheer panel 30, when insert 36 is placed within pocket 34, the insert, or portions thereof, can be seen through the sheer panel.

Breast cups 18 may be manufactured in a shape that conforms to the lower portion of an individual's breast so that the upper portion of the breast is not contained within the breast cup. In such an embodiment, the sheer panel, the insert and the breast-contacting panel would only extend upwardly to a top region generally aligned with seam 28 shown in FIG. 1.

Brassiere 14 and panties 16 may be provided in any color or decorative scheme but typically will be manufactured in a neutral base color such as white, black, red or beige. In the case where the brassiere and panties are manufactured with a colorful combination of colors, multiple inserts may be provided wherein the inserts are each solid in color and wherein the color of the insert matches one of the colors of the decorative scheme of the brassiere and panties.

Still referring to FIG. 1, insert 36 typically is manufactured in a shape corresponding to pocket 34 such that the insert extends through the entire pocket and covers the entire breast area of cup 18. The insert typically includes a seam across a central region of the insert so that the insert has a rounded shaped matching that of the breast cup. The insert may also be manufactured in a shape corresponding to a portion of pocket 34 such as the lower portion of the pocket, i.e., below seam 28, or the upper portion of the pocket, i.e., above seam 28. In the embodiment wherein breast cup 18 only extends over the lower portion of an individual's breast, insert 36 typically will only extend over the same lower portion of the individual's breast.

Insert 36 typically comprises a thin sheet of opaque material having a particular color or decorative scheme. For example, the insert may be manufactured having the following color or decorative schemes: red, green, black, orange, blue, pink, gold, white, yellow, purple, plaid, a sunflower or a rose design, an image, a pattern, a yellow smile face design, words or phrases printed thereon, or any other particular decorative scheme, color, or combination thereof. The insert may be manufactured of any material, for example, velvet, silk, cotton, polyester, or the like. Insert 36 may also be manufactured of a lace or transparent material different from the color of sheer panel 30 so that when the insert is placed within pocket 34, the insert provides a subtle dual-color transparent or lace effect with the transparent or lace effect of sheer panel 30. In the embodiment wherein sheer panel 30 comprises a transparent material, insert 36 may comprise a lace insert having the same or a different color as sheer panel 30 so that the insert changes the decorative style, also called the decorative scheme or appearance, of the brassiere but does not necessarily change the color of the brassiere. For purposes of this disclosure, the "decorative style" of an item means the appearance and/or color of the item described.

Brassiere 14 further includes a decorative attachment 38, such as a bow, secured to central front connection region 24. Bow 38 is detachable from the brassiere so that a variety of colored or decorative bows may be provided to match the color or decorative scheme of inserts 36. For example, bow 38 may be black to match a black insert 36. In other embodiments, attachment 38 may comprise a ribbon, a faux or a real gemstone or pearl, a patch having a well-known shape such as a flower or a star, a button, a button cover, or any other decorative attachment.

The brassiere of the present invention typically can be manufactured and sold at a price competitive with the prices of existing, conventional brassieres. A single insert and matching attachment typically are sold together with the brassiere. Additional inserts and attachments may be sold separately for a minimal cost. Accordingly, an individual may purchase a single brassiere and multiple inserts and/or attachments so that the individual can change the decorative scheme, including the color and/or the appearance, of their brassiere merely by changing the inserts or attachments. By use of the present invention, therefore, an individual can greatly expand the variety of undergarment color and/or appearance of their undergarment wardrobe without the expense of purchasing multiple brassieres.

Still referring to FIG. 1, panties 16 comprise a waistband 46, a front sheer panel 48 and a tummy-contacting panel 50 which define a pocket 52 therebetween for receiving an insert 54. Sheer panel 48 and tummy-contacting panel 50 typically are sewn together along lower regions 51 so that pocket 52 is accessed along a top region 53 of the sheer panel behind the waistband. Access to pocket 52 on an inwardly facing side of the panties ensures that the insert will be held in place by the generally elastic or stretchable nature of the panties as they are stretched across the tummy of the wearer. In the embodiment shown, panties 16 comprise leg regions 55 that extend upwardly to waistband 46 along lower regions 51 of sheer panel 48. In another embodiment, the entirety of a front surface 58 of the panties may be manufactured of sheer material.

Sheer panel 48 may be manufactured of the same materials as sheer panel 30 and insert 54 may be manufactured of the same materials as insert 36. Sheer panel 48 is designated in the figure with cross-hatching for ease of illustration. Pocket 52 and insert 54 typically are triangular in shape but other shapes may also be used. An attachment 56 may be secured to panties 16, such as at waistband 46. Attachment 56 may be manufactured of the same material, design and/or shape as attachments 38.

The panties of the present invention typically are manufactured and sold at a price competitive with the price of existing panties. A single insert and matching attachment typically are sold together with the panties. Additional inserts and attachments may be sold separately for a minimal cost. Accordingly, an individual may purchase a single pair of panties and multiple inserts and/or attachments so that the individual can change the color or appearance of their undergarment wardrobe merely by changing the inserts or attachments. By use of the present invention, therefore, an individual can greatly expand the variety of the color and/or appearance of their undergarment wardrobe without being required the expense of purchasing multiple decorative panties.

Figure 2:
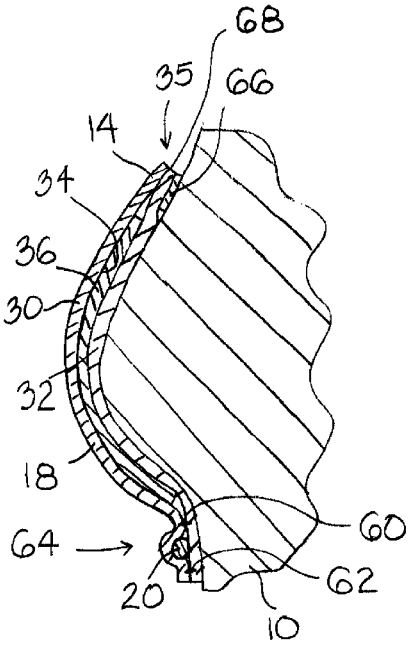
FIG. 2 is a side cross-sectional view of the brassiere of FIG. 1 showing an insert placed within the brassiere cup.

Referring to FIG. 2, brassiere 14 is shown worn on individual 10. Breast-contacting panel 32 is shown positioned adjacent the breast of the individual. Insert 36 is shown positioned within pocket 34 and sheer panel 30 is shown positioned over insert 36 and opposite from panel 32. Panel 32 and panel 30 are secured by stitching 60 and 62 at a lower region 64 of breast cup 18 wherein underwire 20 is positioned between the panels and between stitching 60 and 62.

A stretchable member 66 is secured to an inner surface of breast-contacting panel 32. The stretchable member may comprise elastic or the like and functions to pucker top region 35 of panel 32, to the extent the panel is not stretched across an individual's breast by the shoulder straps and the backstrap of the brassiere, to enclose a top opening 68 of pocket 34. In this manner, insert 36 will be retained within the pocket even though panel 32 may not be secured to panel 30 in top region 35. In other words, stretching of the panels across an individual's breast when the brassiere is worn, together with stretchable member 66, acts to retain insert 36 in place within pocket 34. In other embodiments, panels 30 and 32 may be releasably secured together along top region 35 by snaps, hook and pile fasteners, a zipper, or other such fastening devices. Inserts 36 may also be secured within pocket 34 by attachment of the insert to panel 30 and/or to panel 32 by any known fastener device. Insert 36 typically has a width of a single sheet of material, which is similar to the width of panels 30 and 32. According, the insert has a width of ¼ inch or less, and typically has a width, also called a thickness, of ⅛ inch, and does not function to enhance or shape an individual's breast but is positioned within pocket 34 merely to change the decorative scheme of the brassiere.

Figure 3:
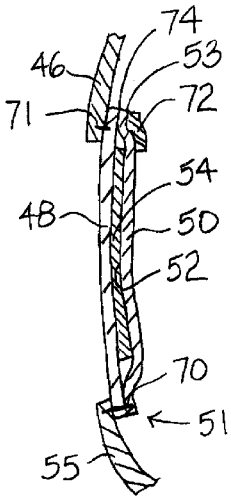
FIG. 3 is a side cross-sectional view of the pair of panties of FIG. 1 showing an insert placed within the panties.

Referring to FIG. 3, panties 14 are shown with insert 54 positioned therein. Tummy-contacting panel 50 is shown secured to front sheer panel 48 and to leg regions 55 by stitching 70 along lower region 51. Insert 54 is shown positioned within pocket 52. Sheer panel 48 is secured to waistband 46 by stitching 71. A stretchable member 72 is secured to an inner surface of tummy-contacting panel 50. The stretchable member may comprise elastic or the like and functions to pucker top region 53 of panel 50 to enclose a top opening 74 of pocket 52. In this manner, insert 54 will be retained within the pocket even though panel 50 may not be secured to panel 48 in top region 53. In other words, stretching of the panels across an individual's tummy when the panties are worn, together with stretchable member 72, acts to retain insert 54 in place within pocket 52. In other embodiments, panels 48 and 50 may be releasably secured together along top region 53 by snaps, hook and pile fasteners, a zipper, or other such fastening devices. Inserts 54 may also be secured within pocket 52 by attachment of the insert to panel 48 and/or panel 50 by any known fastening device. Insert 54 typically has a width similar to the width of panels 48 and 50. According, the insert does not function to flatten or shape an individual's tummy but is positioned within pocket 52 merely to change the color or appearance of the pair of panties.

Figure 4:
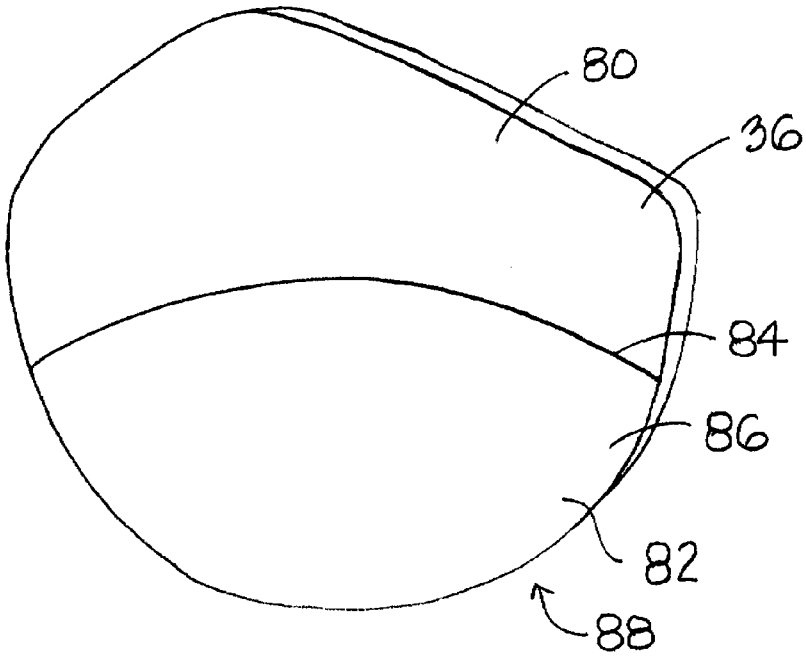
FIG. 4 is a perspective view of the insert of FIG. 2.

Referring to FIG. 4, which is a perspective view of the insert of FIG. 2, insert 36 is shown having a top portion 80 and a lower portion 82 secured together at a seam 84. The outline shape of insert 36 typically matches the shape of the pocket of the brassiere so that the insert will extend over the entire breast cup area. The insert shown is a right breast cup insert whereas a left breast cup insert will have a mirror image shape of the insert shown. In the embodiment shown, a front surface 86 of insert 36 is one color, such as green, whereas a back surface 88 of the insert is another color, such as red. A mirror image insert with the same color scheme is sold together with the insert shown. Accordingly, by purchasing a single set of inserts, an individual can change the color scheme of their brassiere to be green or red. In other embodiments, other color or decoration schemes can be utilized. In still another embodiment, the inserts will have the same color on both sides of each of the mirror image inserts so that either insert will fit within a right or a left breast cup pocket of the brassiere.

Still referring to FIG. 4, insert 36 may be treated with perfume, scented oils, chemicals, or by other scented means so that the insert has a pleasing scent. In particular, insert 36 may be treated or manufactured to have a scent such as: one of a variety of perfumes, such as a musk or a sweet scent; flowers such as roses, carnations or freesia; baby powder; foods such as lemons, strawberries, cinnamon or chocolate; outdoorsy scents, such as newly fallen rain or pine needles; or other pleasant scents. In a preferred embodiment the scent of the insert is coordinated with the color or decorative scheme of the insert. For example, a pair of pink brassiere inserts and a pink panties insert may be carnation scented. Accordingly, an individual may place the appropriate colored and scented inserts into their undergarments so that a unique undergarment set is created. In this embodiment, wherein the inserts have a scent, the inserts may require drying cleaning or the re-application of a scent once the insert has been washed and dried in a typical washer and dryer.

Figure 5:
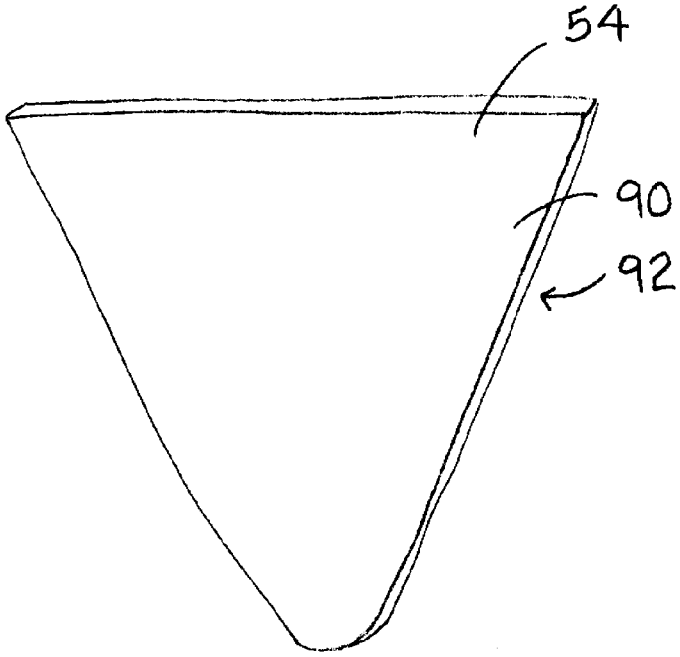
FIG. 5 is a perspective view of the insert of FIG. 3.

Referring to FIG. 5, which is a perspective view of the insert of FIG. 3, insert 54 is shown having a generally triangular shape. The outline shape of insert 54 typically matches the shape of pocket 52 of the pair of panties so that the insert will extend over the entire sheer area of sheer panel 48. In the embodiment shown, a front surface 90 of insert 36 is one color, such as green, whereas a back surface 92 of the insert is another color, such as red. Accordingly, by purchasing a single insert, an individual can change the color scheme of their pair of panties to be green or red. In other embodiments, other color or decoration schemes can be utilized. In another embodiment the insert has the same color on both sides so that the insert can be placed in pocket 52 facing either direction.

In the embodiment shown, insert 54 extends over a small portion of the front of pair of panties 16. In other embodiments, insert 54 and pocket 52 may comprise the entire front facing surface of the pair of panties. In yet other embodiments the outline shape of the insert may be circular, square, or any other such shapes. The insert may also be treated to have a pleasant scent similar to inserts 36.

Figure 6:
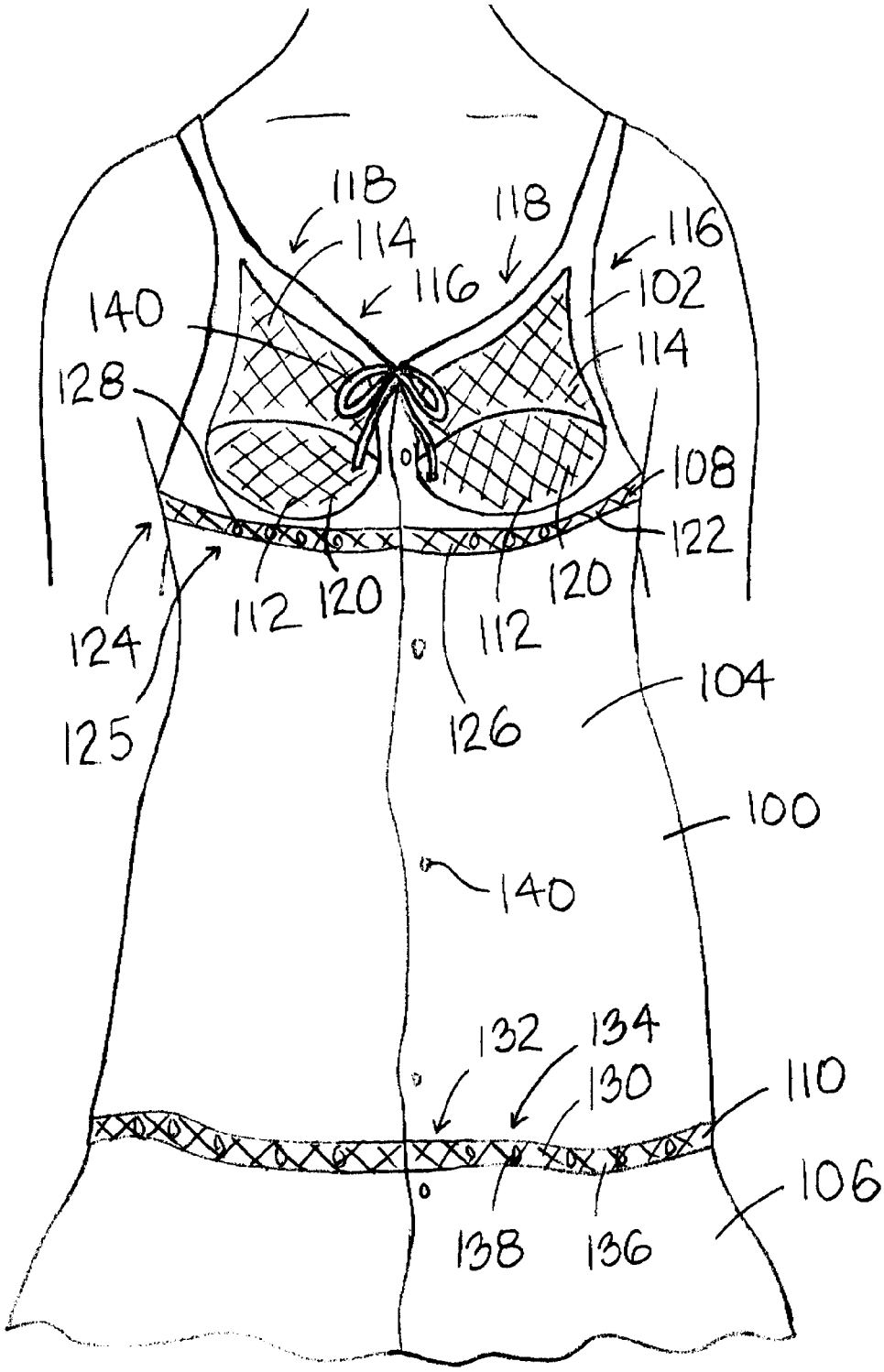
FIG. 6 is a front environmental view of a nightgown of the present invention worn by an individual.

Referring to FIG. 6, which is a front environmental view of a nightgown of the present invention worn by an individual, nightgown 100 comprises a bodice portion 102, a central body portion 104, and a lower frill portion 106. An accent trim 108 extends between bodice 102 and body portion 104, and an accent trim 110 extends between body portion 104 and frill 106. Bodice 102 includes two breast cups 112 each having a front sheer panel 114 and a breast-contacting panel 116 which define a pocket 118 therebetween. Sheer panels 114 are shown as cross-hatched for ease of illustration. Inserts 120 are placed within pockets 118 and can be seen through sheer panel 114. Similar to brassiere 14 discussed above, inserts 120 and pockets 118 typically extend over the entire breast cup area. However, the pockets and the inserts may be manufactured in any shape as desired. Inserts 120 may be manufactured of the same materials and in the same decorator schemes as inserts 36.

Accent trim 108 comprises a front sheer panel 122 and a torso-contacting panel 124 that define an elongate pocket 125 therebetween. An insert 126 is received in pocket 125 and typically comprises an elongate, flat ribbon having a color or decorative scheme that matches the color or decorative scheme of inserts 120. In the preferred embodiment sheer panel 122 comprises lace having multiple apertures 128 therein, and wherein insert 126 is threaded through the multiple apertures to position the insert in pocket 125.

Similarly, accent trim 110 comprises a front sheer panel 130 and a leg-contacting panel 132 that define an elongate pocket 134 therebetween. An insert 136 is received in pocket 134 and typically comprises an elongate, flat ribbon having a color or decorative scheme that matches the color or decorative scheme of inserts 120. In the preferred embodiment sheer panel 130 comprises lace having multiple apertures 138 therein, and wherein insert 136 is threaded through the multiple apertures to position the insert in pocket 134.

Nightgown 100 further comprises attachments 140 that may be positioned at the top of bodice 102, at accent trims 108 and 110, or at any other location on the nightgown. Attachments 100 typically comprise the same types of attachments as described with respect to attachments 38, such as bows or button covers.

Figure 7:
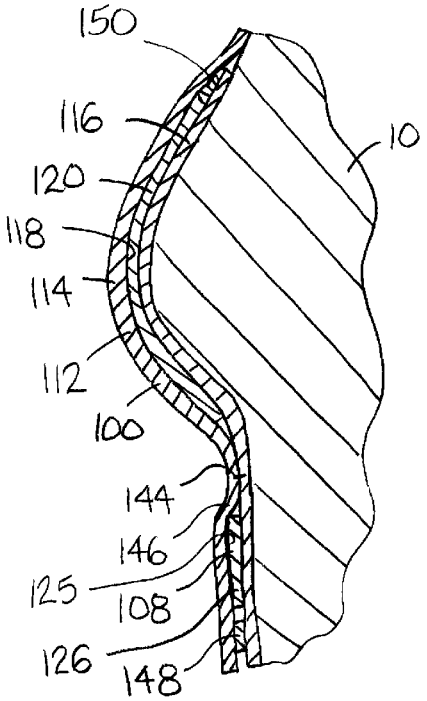
FIG. 7 is a side cross-sectional view of the upper portion of the nightgown of FIG. 6 showing two inserts placed within the nightgown.

Referring to FIG. 7, which is a side cross-sectional view of bodice portion 102 of the nightgown of FIG. 6 showing an insert placed within the brassiere cup of the nightgown and an insert within the accent trim area, nightgown 100 is shown worn on an individual 10. Breast-contacting panel 116 is shown positioned adjacent the breast of the individual. Insert 120 is shown positioned within pocket 118 and sheer panel 114 is shown positioned over insert 120 and opposite from panel 116.

Panel 114 and panel 116 are secured by stitching 144 at a lower region 146 of breast cup 112 wherein accent trim 108 is positioned between the panels and between stitching 144 and an attachment device 148. Panels 114 and 116 are secured at a top region by a fastening device 150, also called an attachment device. Attachment devices 148 and 150 may comprise hook and pile fasteners, elastic, a zipper, a row of snaps or buttons, or the like. In the case of hook and pile fasteners, a zipper or other mating attachment means, corresponding components of attachment devices 148, and/or 150, are each attached to panels 114 and 116, as will be understood by those skilled in the art. In the case of elastic, the elastic may be sewn to either of panels 114 or 116. The elastic functions to hold the two panels against one another so that insert 126, and/or insert 120, are not displaced therefrom. In addition, the elastic will act to conform the nightgown to the chest of the individual so that the bodice portion of the nightgown is form fitting. Inserts 120 and/or 126 may also be secured within pockets 118, and/or 125, by attachment of the inserts to panel 114 or to panel 116 by any known fastener device.

Figure 8:
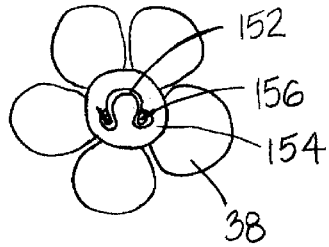
FIG. 8 is a rear view of an attachment which is secured to the undergarments of the present invention by a hook and eye fastener.

Referring to FIG. 8, which is a rear view of one embodiment of the attachment which is secured to the undergarments of the present invention by a hook fastener, attachment 38 comprises a patch in the shape of a flower having a "U" shaped "eye" 152 secured to the back surface 154 of the patch by stitching 156. "U" shaped "eye" 152 is secured to the undergarment by a mating hook secured to the undergarment, as known in the art. Attachments 56 and 140 may also comprise the same fastening devices as described with respect to attachments 38.

Figure 9:
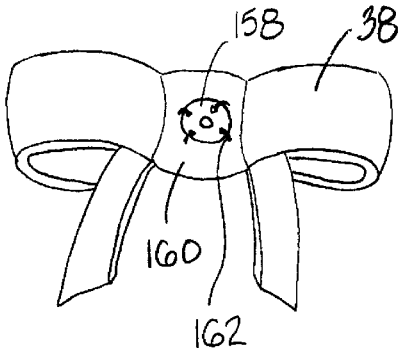
FIG. 9 is a rear view of an attachment which is secured to the undergarments of the present invention by a snap fastener.

Referring to FIG. 9, which is a rear view of an attachment which is secured to the undergarments of the present invention by a snap fastener, attachment 38 comprises a bow made of ribbon or thread having a socket 158 secured to a back surface 160 by stitching 162. The socket is secured to the undergarment by a matching ball secured to the undergarment, as known in the art. Attachments 56 and 140 may also comprise the same fastening devices as described with respect to attachments 38.

Figure 10:
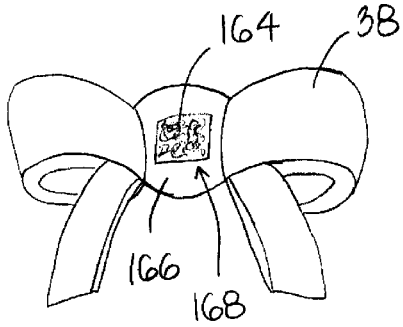
FIG. 10 is a rear view of an attachment which is secured to the undergarments of the present invention by a hook and pile fastener.

Referring to FIG. 10, which is a rear view of an attachment which is secured to the undergarments of the present invention by a hook and pile fastener, attachment 38 comprises a bow made of ribbon or thread having a piece of "hook" type material 164 secured to a back surface 166 by adhesive 168. The "hook" material is secured to the undergarment by a matching piece of "pile" material secured to the undergarment, as known in the art. Attachments 56 and 140 may also comprise the same fastening devices as described with respect to attachments 38.

Figure 11:
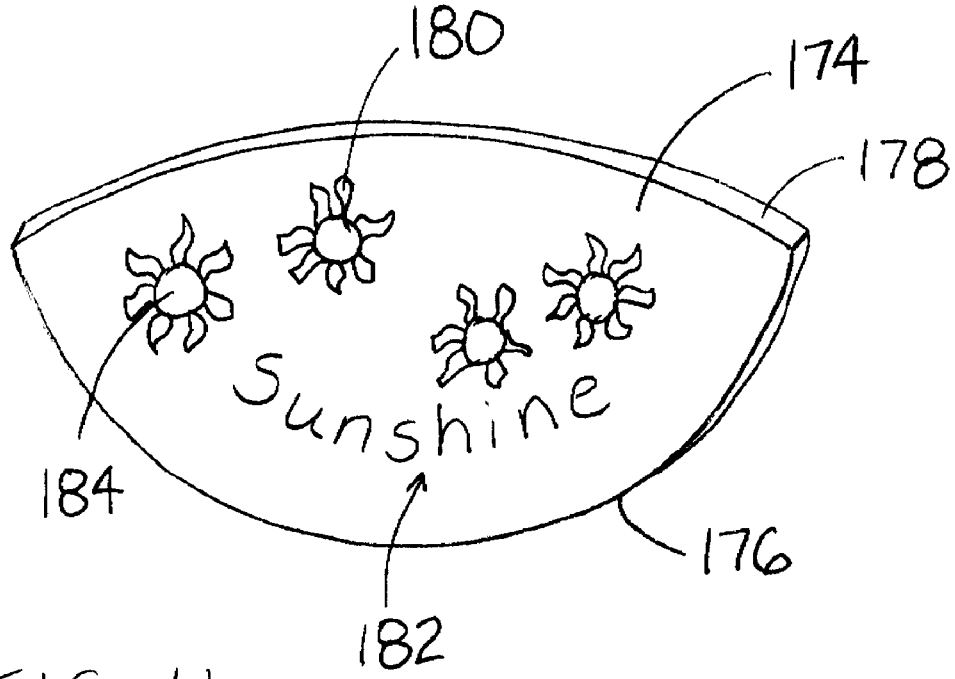
FIG. 11 is a perspective view of another insert of the present invention.

Referring to FIG. 11, which is a perspective view of another insert of the present invention, insert 174 comprises an insert that may be placed within the lower portion of a breast cup pocket if the pocket covers the entire breast of an individual. Insert 174 may also be placed with the pocket of a breast cup wherein the breast cup covers only the lower portion of the breast of an individual. Accordingly, insert 174 has a rounded lower surface 176 and a slightly curved upper surface 178. When insert 174 is compared to insert 36 of FIG. 4, upper surface 178 of insert 174 is positioned in approximately the same location as seam 84 of insert 36. Insert 174 may comprise a decorative pattern 180 including words 182 and decorative designs 184, such as the picture of a sun, printed or sewn onto the insert. The insert may be the color blue wherein words 182 and designs 184 may be the color yellow. The color of the insert and the words and designed placed thereon will typically show through the sheer panel of the undergarment in which the insert is placed thereby changing the decorative scheme, including the color and/or appearance, of the undergarment.

While preferred embodiments of the present invention have been shown and described, it will be apparent to those skilled in the art that many changes and modifications may be made without departing from the invention in its broader aspects. The appended claims are intended to cover, therefore, all such changes and modifications as fall within the true spirit and scope of the invention.

I claim:

1. An undergarment set comprising:

a pair of panties including a tummy-contacting panel and a first front sheer panel wherein said first front sheer panel is secured to said tummy-contacting panel to define a first pocket therebetween and wherein said first front sheer panel is transparent;

a first insert removably received within said first pocket wherein said first insert comprises a decorative scheme that is visible through said first front sheer panel when said pair of panties are worn by a person and wherein said decorative scheme is distinguishable from human skin;

a bodice piece including a breast-contacting panel and a second front sheer panel wherein said second front sheer panel is secured to said breast-contacting panel to define a second pocket therebetween and wherein said second front sheer panel is transparent; and a second insert removably received within said second pocket wherein said second insert comprises a decorative scheme that is visible through said second front sheer panel when said bodice piece is worn by a person and wherein said decorative scheme of the second insert matches the decorative scheme of the first insert and is distinguishable from human skin.

2. The undergarment set of claim 1 wherein said first insert has a thickness that extends from said tummy-contacting panel to said first front sheer panel and is ¼ inch or less, and wherein said second insert has a thickness that extends from said breast-contacting panel to said second front sheer panel and is ¼ inch or less.

3. The undergarment set of claim 1 wherein the decorative scheme of the first and the second inserts comprises a colored outer surface wherein the color of each of the colored outer surfaces is chosen from the group consisting of: black, white, red, green, blue, yellow, orange, pink, purple or gold.

4. The undergarment set of claim 1 wherein said first pocket includes a first opening and wherein said pair of panties includes a first attachment device that secures said first opening in a closed position to secure said first insert within said first pocket, wherein said second pocket includes a second opening and wherein said bodice piece includes a second attachment device that secures said second opening in a closed position to secure said second insert within said second pocket, and wherein said first and second attachment devices are each chosen from the group consisting of: elastic, zippers, mating hook and pile material, and snap fasteners.

5. The undergarment set of claim 1 wherein said pair of panties includes a first attachment releasably secured thereto, wherein said bodice piece includes a second attachment releasably secured thereto, and wherein said first and second attachments each include a decorative scheme that matches the decorative scheme of the first insert.

6. The undergarment set of claim 5 wherein said first and said second attachments each comprise a decoration chosen from the group consisting of: a bow, a gemstone, a button, a button cover, and a patch.

7. The undergarment set of claim 1 wherein said bodice piece comprises a clothing piece chosen from the group consisting of: a nightgown, a brassiere, a boustier, a chemise, a teddy including said pair of panties, a corset, and a swimsuit top.

8. The undergarment set of claim 1 wherein said first insert comprises a flat, triangular piece of material and wherein said second insert comprises a cup-shaped piece of material having a seam extending therethrough wherein said seam produces said cup shape.

9. The undergarment set of claim 1 further comprising a third insert sized to be received within said first pocket wherein said third insert comprises a decorative scheme different from the decorative scheme of said first insert, and further comprising a fourth insert sized to be received within said second pocket wherein said fourth insert comprises a decorative scheme that matches the decorative scheme of the third insert.

10. The undergarment set of claim 1 wherein said bodice piece comprises a nightgown including:

a leg-contacting panel and a third front sheer panel wherein said third front sheer panel is secured to said leg-contacting panel to define a third pocket therebetween and wherein said third front sheer panel is transparent; and a third insert removably received within said third pocket wherein said third insert is elongate and comprises a decorative scheme that is visible through said third front sheer panel when said nightgown is worn by a person and wherein said decorative scheme is distinguishable from human skin.

11. A method of changing the decorative style of an undergarment set comprising the steps of:

providing an undergarment set comprising:

a pair of panties including a tummy-contacting panel and a first front sheer panel wherein said first front sheer panel is secured to said tummy-contacting panel to define a first pocket therebetween and wherein said first front sheer panel includes transparent regions;

a first insert removably received within said first pocket wherein said first insert comprises a decorative style that is visible through said transparent regions of the first front sheer panel when said pair of panties is worn by a person and wherein said decorative style is distinguishable from human skin;

a bodice piece including a breast-contacting panel and a second front sheer panel wherein said second front sheer panel is secured to said breast-contacting panel to define a second pocket therebetween and wherein said second front sheer panel includes transparent regions; and a second insert removably received within said second pocket wherein said second insert comprises a decorative style that is visible through said transparent regions of the second front sheer panel and wherein the decorative style of the second insert matches the decorative style of the first insert and wherein said decorative style is distinguishable from human skin;

providing a third insert sized to be received within said first pocket wherein said third insert comprises a decorative style different from the decorative style of said first insert;

providing a fourth insert sized to be received within said second pocket wherein said fourth insert comprises a decorative style that matches the decorative style of said third insert;

removing said first insert from said first pocket and placing said third insert in said first pocket so that said third insert is visible through said transparent regions of said first front sheer panel when said pair of panties is worn by a person; and removing said second insert from said second pocket and placing said fourth insert in said second pocket so that said fourth insert is visible through said transparent regions of said second front sheer panel when said bodice piece is worn by a person.

12. The method of changing the decorative style of an undergarment set of claim 11 wherein said first insert has a width that extends from said tummy-contacting panel to said first front sheer panel and is ⅛ inch or less, and wherein said second insert has a width that extends from said breast-contacting panel to said second front sheer panel and is ⅛ inch or less.

13. The method of changing the decorative style of an undergarment set of claim 11 wherein the first insert comprises first and second colored outer surfaces wherein the color of the first and second outer surfaces are different from each other and are each chosen from the group consisting of: black, white, red, green, blue, yellow, orange, pink, purple or gold.

14. The method of changing the decorative style of an undergarment set of claim 11 wherein said first pocket includes a first opening and wherein said pair of panties includes a first attachment device that secures said first opening in a closed position to secure said first insert within said first pocket, wherein said second pocket includes a second opening and wherein said bodice piece includes a second attachment device that secures said second opening in a closed position to secure said second insert within said second pocket, and wherein said first and second attachments devices are each chosen from the group consisting of: elastic, zippers, mating hook and pile material, and snap fasteners.

15. The method of changing the decorative style of an undergarment set of claim 11 wherein said pair of panties includes a first attachment releasably secured thereto, wherein said bodice piece includes a second attachment releasably secured thereto, and wherein said first and second attachments each include a decorative style that matches the decorative style of the first insert.

16. The method of changing the decorative style of an undergarment set of claim 11 wherein said first and said second attachments each comprise a decoration chosen from the group consisting of: a bow, a ribbon, a faux gemstone, a real gemstone, a button, a button cover, and a patch.

17. The method of changing the decorative style of an undergarment set of claim 11 wherein said bodice piece comprises a clothing piece chosen from the group consisting of: a nightgown, a brassiere, a boustier, a chemise, a corset, and a swimsuit top.

18. The method of changing the decorative style of an undergarment set of claim 11 wherein said first insert comprises a flat, triangular piece of material and wherein said second insert comprises a cup-shaped piece of material having a seam extending therethrough wherein said seam produces said cup shape.

19. The method of changing the decorative style of an undergarment set of claim 11 wherein said bodice piece comprises a nightgown including:

a leg-contacting panel and a third front sheer panel wherein said third front sheer panel is secured to said leg-contacting panel to define a third pocket therebetween and wherein said third front sheer panel includes transparent regions; and a third insert removably received within said third pocket wherein said third insert is elongate and comprises a decorative style that is visible through said transparent regions of the third front sheer panel when said nightgown is worn by a person and wherein said decorative style is distinguishable from human skin.

20. The method of changing the decorative style of an undergarment set of claim 11 wherein said first insert has a scent which permeates through said first front sheer panel, and wherein said second insert has a scent which permeates through said second front sheer panel.

21. A method of changing the decorative style of an undergarment comprising the steps of:

providing an undergarment comprising:

a bodice piece including a breast-contacting panel and a front sheer panel wherein said front sheer panel is secured to said breast-contacting panel to define a pocket therebetween and wherein said front sheer panel is transparent; and a first insert removably received within said pocket wherein said first insert comprises a decorative style that is visible through said front sheer panel and wherein the decorative style of the first insert is distinguishable from human skin;

providing a second insert sized to be received within said pocket wherein said second insert comprises a decorative style that is different from the decorative style of said first insert and is distinguishable from human skin; and removing said first insert from said pocket and placing said second insert in said pocket so that said second insert is visible through said front sheer panel when said bodice piece is worn by a person.

22. The method of changing the decorative style of an undergarment of claim 21 wherein the first insert has a thickness of ¼ inch or less.

23. The method of changing the decorative style of an undergarment of claim 21 wherein the first insert has a first surface having a decorative style and a second surface having a decorative style, wherein the decorative style of said first surface is different from the decorative style of said second surface, and wherein only one of said first or second surfaces is visible through said front sheer panel when said bodice piece is worn by a person.

* * * * *